US005650921A

United States Patent [19]

Imaizumi et al.

[11] Patent Number: 5,650,921

[45] Date of Patent: Jul. 22, 1997

[54] ELECTRONIC COMPONENT ASSEMBLY

[75] Inventors: Yumi Imaizumi, Saitama; Ryoji Naito; Scott Pinizzotto, both of Tokyo, all of Japan

[73] Assignee: Sony Corporation, Tokyo, Japan

[21] Appl. No.: 490,901

[22] Filed: Jun. 16, 1995

[30] Foreign Application Priority Data

Jun. 24, 1994 [JP] Japan ..... 6-164945

[51] Int. Cl.[6] ..... H01R 23/68

[52] U.S. Cl. ..... 361/785; 361/786; 361/752; 439/76.1

[58] Field of Search ..... 361/679, 814, 361/815, 817, 752, 786, 785, 742, 758; 439/578, 76.1, 433, 434, 551, 550, 561, 562, 564

[56] References Cited

U.S. PATENT DOCUMENTS 2,306,389 12/1942 Jorgensen ..... 403/282

4,590,540 5/1986 Nicholson et al. ..... 361/682

*Primary Examiner*—Leo P. Picard

*Assistant Examiner*—Phuong T. Vu

*Attorney, Agent, or Firm*—Jay H. Maioli

[57] ABSTRACT

An electronic component assembly including a connector hole built as part of an enclosure serving as a cabinet of electronic device, where the connector hole is used for passing through an electric connector connecting a component inside the cabinet to an external device installed outside the cabinet, has a knurled portion with a plurality of dents provided around the inside of the hole for preventing the connector from rotating by engaging the corners of the flange in the connector with any of the dents. As a result, other parts, including a rear terminal assembly for preventing the connector from rotating, and the number of the assembly operations can be eliminated. The cost and processes of molding other parts can also be eliminated.

8 Claims, 7 Drawing Sheets

ELECTRONIC COMPONENT ASSEMBLY

BACKGROUND OF THE INVENTION

1. Field of the Invention

The present invention relates to an electronic component assembly employed in electronic equipment such as a television receiver whose electronic component assembly has a rotation preventing mechanism. An example of such an electronic component assembly is an F connector which typically connects an antenna cable to a tuner located inside the cabinet of the electronic equipment.

2. Description of Related Art

In recent years, a plurality of units of electronic equipment such as television receivers and video decks are available for home use. The popularization of such electronic equipment is progressing at an extremely high speed. For this reason, efforts are made to improve the production capability by, for example, simplifying manufacturing processes so as to meet such rising demands and, at the same time, to make maintenance work of the electronic equipment easy to do. An example of results of such efforts is implementation of an installation structure such as an enclosure containing a television receiver into a single structure. That is to say, by reducing the number of structural components constituting the cabinet, for example, the assembly process can be carried out with a high degree of efficiency.

In the case of a television receiver or a video deck, in order to connect a tuner located inside its cabinet to an antenna installed at a place external to the cabinet, a connector hole is provided at a predetermined position on the cabinet. Typically, an F connector or the like passing through such a through hole is used for connecting the tuner to the antenna.

FIGS. 7 to 9 are diagrams showing a typical F connector assembly with FIG. 7 showing a perspective view, FIG. 8 showing a side view and FIG. 9 showing a front view of the assembly. Reference numeral 30 shown in these figures is a connector whereas reference numeral 31 is an F connector for connecting an antenna cable extended from an external antenna. Reference numeral 32 denotes a screw coupler with radial threads cut thereon whereas reference numeral 33 is a flange, typically having a hexagonal shape with six corners 33*a*. Reference numeral 34 denotes a pin plug to be connected to a tuner provided on a board inside the cabinet of a television receiver.

The connector 30 is inserted into a connector hole from the inside of the cabinet of a television receiver till the flange 33 comes into contact with the back of the connector hole. At that time, the screw coupler 32 protrudes to the outside of the cabinet of the television receiver.

Then, a connection unit provided on an antenna cable is connected to the screw coupler 32 of the F connector 31 protruding out off the connector hole. In the case of a connection unit having a configuration built as a spring mechanism, for example, the connection unit is installed by pushing it toward the screw coupler 32 so as to let the screw coupler 32 be inserted into the connection unit. In the case of a connection unit having a female thread, on the other hand, the connection unit is installed by rotating it around the screw coupler 32 so as to let the connection unit be attached and fixed on the screw coupler 32.

When coupling a connection unit with a female thread to the screw coupler 32, the connector 30 may also be inevitably rotated as well, making it impossible to install the connection unit smoothly. As a result, the connector 30 is difficult to connect. It is therefore necessary to prevent the connector 30 from rotating. In order to solve this problem, another component having a rotation preventing mechanism such as a rear terminal assembly is typically provided on a portion of the connector 30 engaging with the connector hole in order to prevent the connector 30 from being rotated.

However, the use of another component such as the rear terminal assembly increases the number of components and, hence, the number of assembly processes, giving rise to a problem that the cost increases due to the need for a mold for forming the rear terminal assembly or the like.

SUMMARY OF THE INVENTION

In order to solve the problems described above, the present invention provides an electronic component assembly which, by passing a connector with a polygonal flange through a connector hole on the cabinet of electronic equipment, allows a circuit board inside the cabinet to be connected to equipment installed outside the cabinet. The electronic component assembly provided by the present invention includes a connector hole drilled through a predetermined location on an enclosure serving as a cabinet of electronic equipment which connector hole has a knurled portion around the hole on the inside for engaging the flange of a connector with the connector hole.

The connector can be an F connector employed in a television receiver, a video deck and other kinds of electronic equipment.

As described above, the electronic component assembly provided by the present invention includes a connector hole built as part of an enclosure serving as a cabinet of electronic equipment whose hole is used for passing through a connector connecting a component inside the cabinet to an external device installed outside the cabinet and has a knurled portion with a plurality of dents provided around the hole on the inside thereof. The connector can therefore be prevented from rotating by engaging the corners of the flange in the connector with any of the plurality of dents. As a result, other parts including the rear terminal assembly for preventing the connector from rotating and the number of the assembly processes can be eliminated. The cost and processes of molding other parts can also be eliminated.

DETAILED DESCRIPTION OF THE PREFERRED EMBODIMENTS

An embodiment implementing a typical application of the electronic component assembly provided by the present invention to a television receiver is described as follows.

Figure 1:
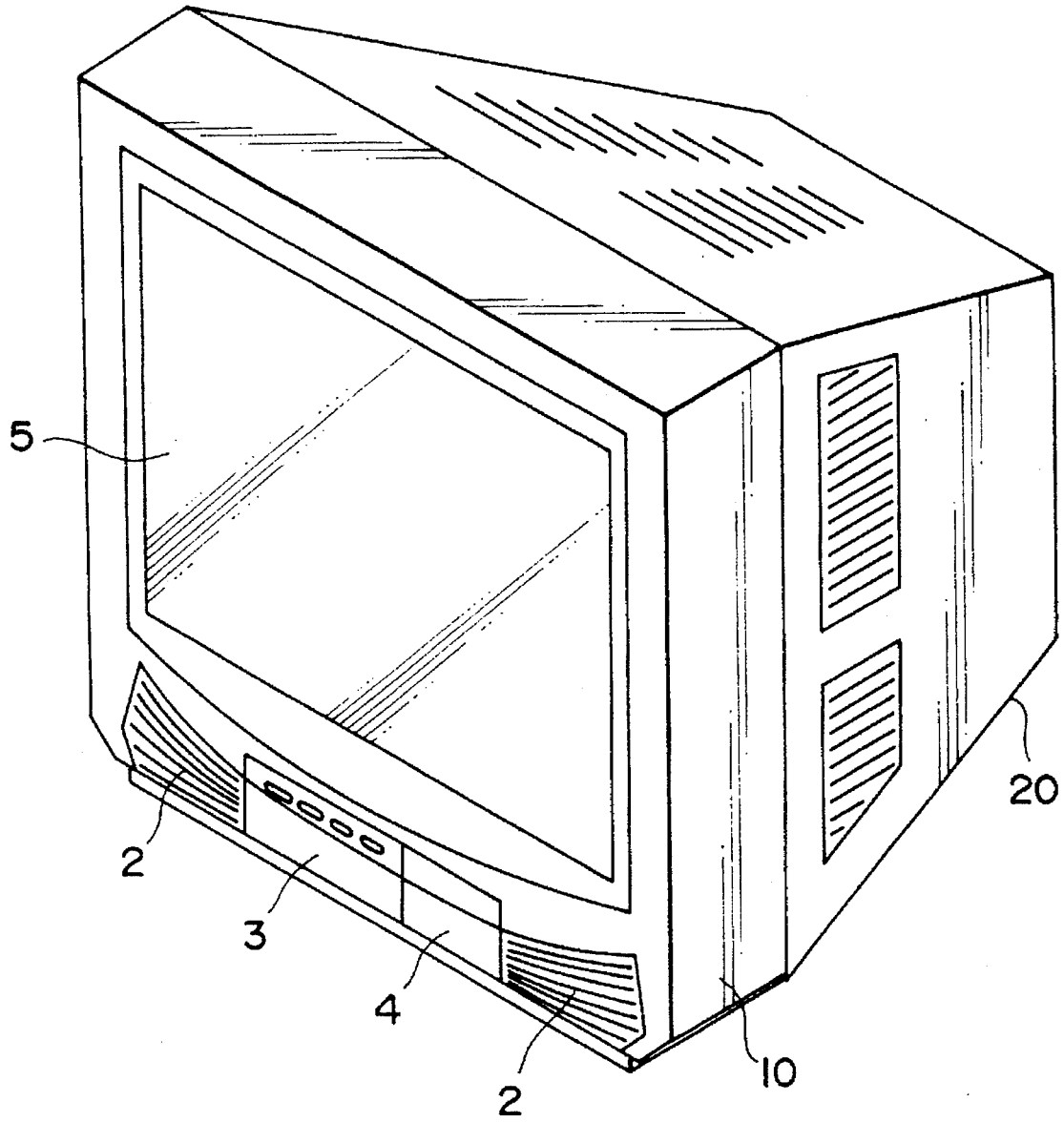
FIG. 1 is an external perspective view of the embodiment implementing the application of an electronic component assembly provided by the present invention to a television receiver.

FIG. 1 is an external perspective view of the embodiment implementing the application of an electronic component assembly provided by the present invention to a television receiver. In the figure, reference numeral 1 is a television receiver. Reference numeral 10 denotes a front enclosure of the cabinet of the television receiver 1. Reference numeral 20 is a rear enclosure.

Reference numeral 2 denotes a pair of speaker grills built on the lower portion of the front of the front enclosure 10. Speakers for generating sound are provided inside the cabinet behind the speaker grills. Reference numeral 3 is an operation unit comprising a variety of controls for typically turning on and off the power, incrementing and decrementing the channel number, increasing and decreasing the volume, switching the input channel and carrying out other operations as well as a light receiving unit for receiving commands from, among other devices, a remote controller. It should be noted that the remote controller itself is not shown in the figure.

Reference numeral 4 is a front terminal unit in which components such as a headphone terminal and video and audio terminals are typically provided. Normally, the front terminal unit is concealed by means of a cover as shown in the figure when the terminals therein are not in use. Reference numeral 5 denotes a CRT.

Figure 2:
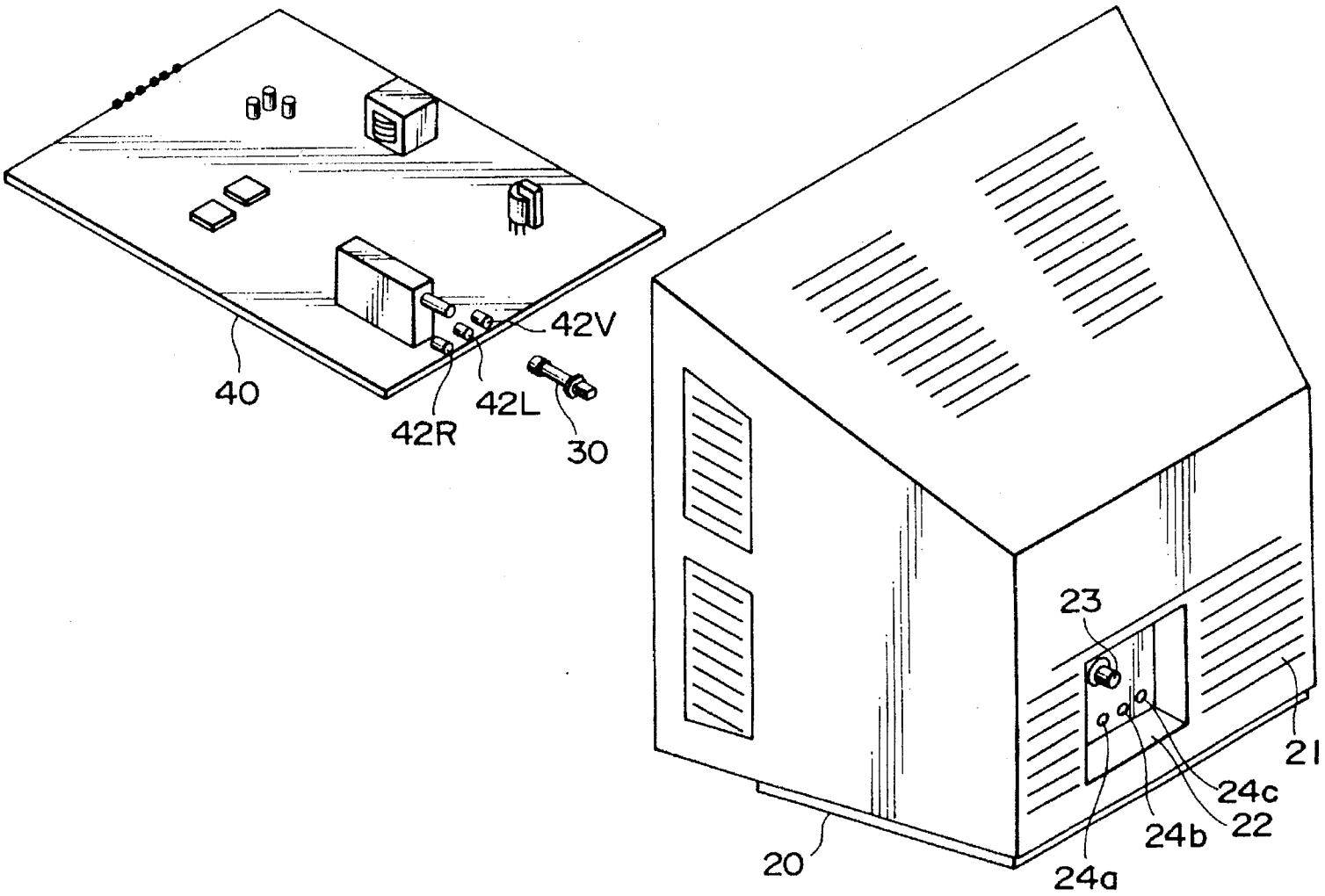
FIG. 2 is an external perspective view of disassembled components of the television receiver in which the embodiment is implemented.

FIG. 2 is an external perspective view of disassembled components of the television receiver 1 as seen from the rear, in which an embodiment of the present invention is implemented. It should be noted that only major components are shown in the figure. Components such as the front enclosure 10 and the CRT 5 are not shown in the figure.

Figure 3:
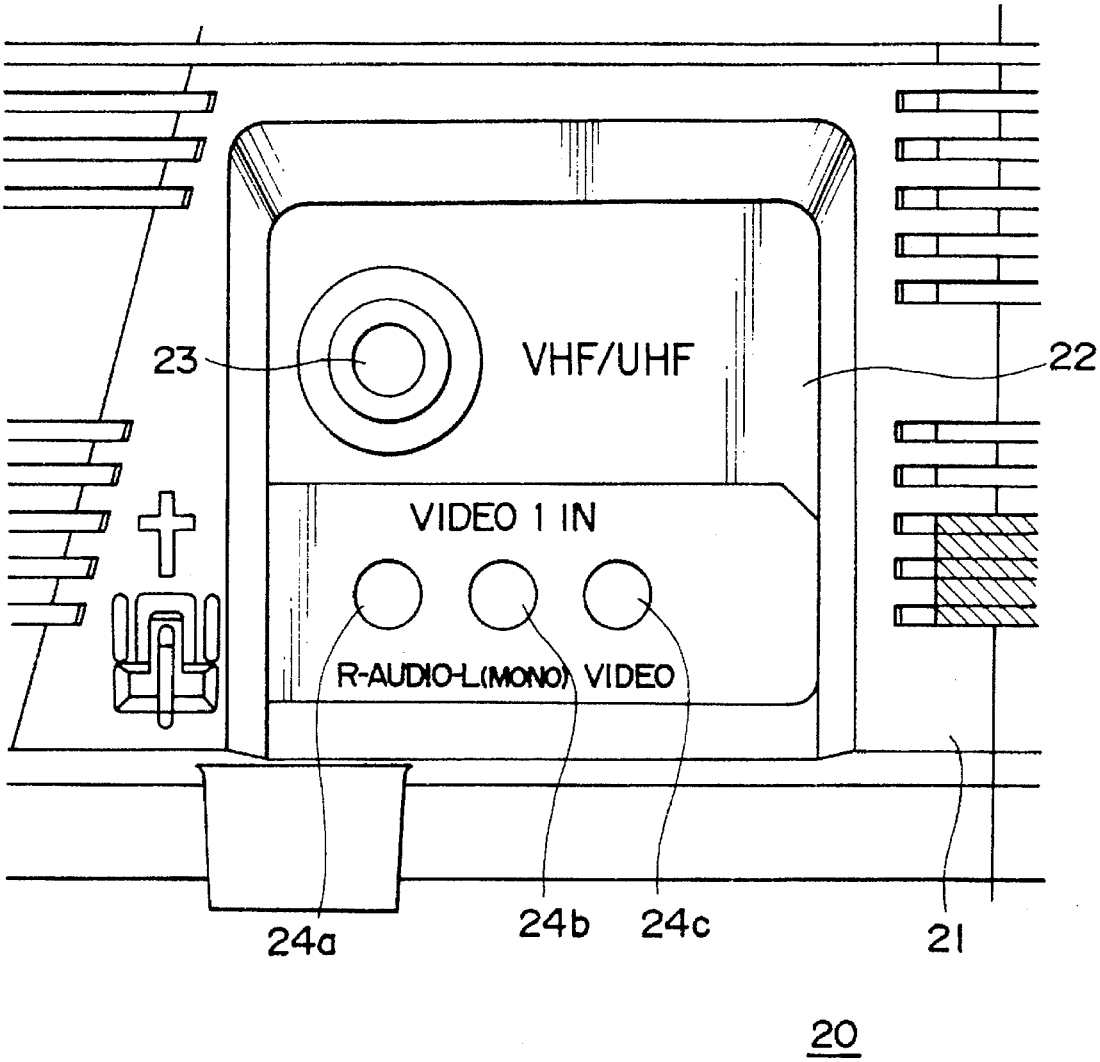
FIG. 3 is an enlarged view of a rear terminal unit.

In the figure, reference numeral 20 is the rear enclosure shown in FIG. 1 whereas reference numeral 21 is a rear board of the rear enclosure 20. Reference numeral 22 is a rear terminal unit built on the rear board 21. As partially shown in an enlarged size in FIG. 3, the rear terminal unit 22 is a single body typically comprising, among other things, a connector hole 23 for passing through an F connector 31 of a connector 30 and through holes 24*a*, 24*b* and 24*c* for passing through terminals such as video and audio terminals of a board 40 to be described later. The connector hole 23 and the through-holes 24*a*, 24*b* and 24*c* are drilled at locations through which the connector 30 and the video and audio input terminals provided on the board 40 can protrude outward at the time the board 40 is installed on the rear enclosure 20. It should be noted that the connector hole 23 is shown in detail in FIGS. 4 and 5.

The board 40 typically comprises components such as various functional circuits of the video and audio systems other than circuits constituting a CRT board and switches. Reference numeral 41 is a tuner having a terminal 41*a* connected to a pin plug 34 of the connector 30, as shown in FIG. 6A. Reference numeral 42V is a video input terminal whereas reference numeral 42L and 42R denote audio input terminals.

When the television receiver 1 of the embodiment is assembled, the pin plug 34 of the connector 30 is first connected to the terminal 41*a* of the tuner 41 and the board 40 is installed typically on the bottom of the front enclosure 10, not shown in the figure, by means of a slide mechanism and other components. Then, the board 40 and the front enclosure 10 are installed on the rear enclosure 20 in such a way that the F connector 31 of the connector 30 protrudes outward through the connector hole 23 whereas the video input terminal 42V and the audio input terminals 42L and 42R protrude outward through the through-holes 24*a*, 24*b* and 24*c* respectively.

Figure 4:
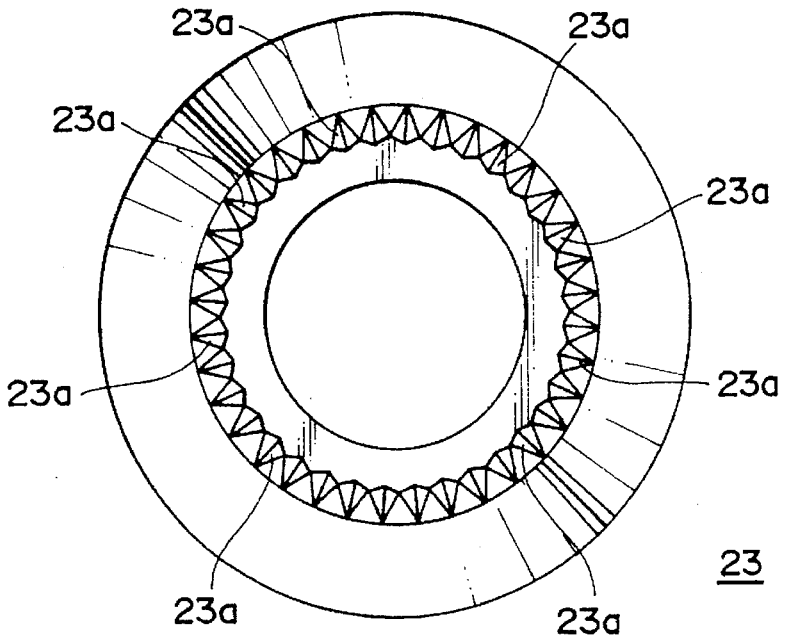
FIG. 4 is a diagram showing the shape of the knurled portion of a connector hole.
Figure 5:
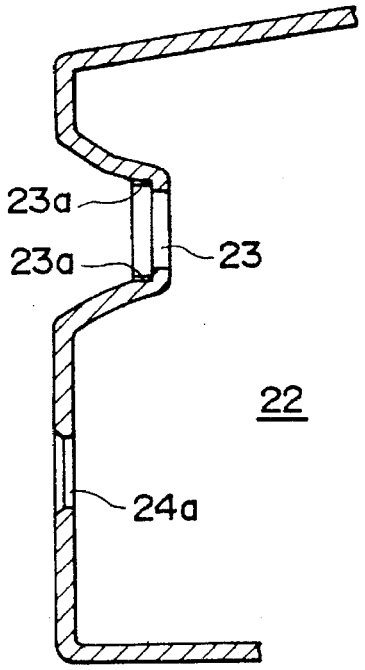
FIG. 5 is a cross sectional view of a connector hole.

Next, the connector hole 23 of the rear terminal unit 22 is explained by referring to FIGS. 4 and 5 as follows. FIG. 4 is a diagram showing the connector hole 23 seen when viewing the back of the rear enclosure 20. FIG. 5 is a cross sectional view of the rear terminal unit 22. Reference numerals 23*a* shown in these figures denote dents forming a knurled shape created on the inside circumference of the connector hole 23. It should be noted that, in this embodiment, thirty six dents 23*a* are created.

With the dents 23*a* created to form a knurled shape on the inside circumference of the connector hole 23 in accordance with the present invention as described above, the corners 33*a* of the flange 33 are engaged with some of the dents 23*a* when the F connector 31 is inserted into the connector hole 23 from the inside of the rear enclosure 20 as described earlier. It should be noted that the flange 33 has typically six corners 33*a*. By having the corners 33*a* of the flange 33 engaged with the dents 23*a*, the connector 30 can be prevented from rotating in a state where the connector 30 has been fixed to the connector hole 23.

Figure 6B:
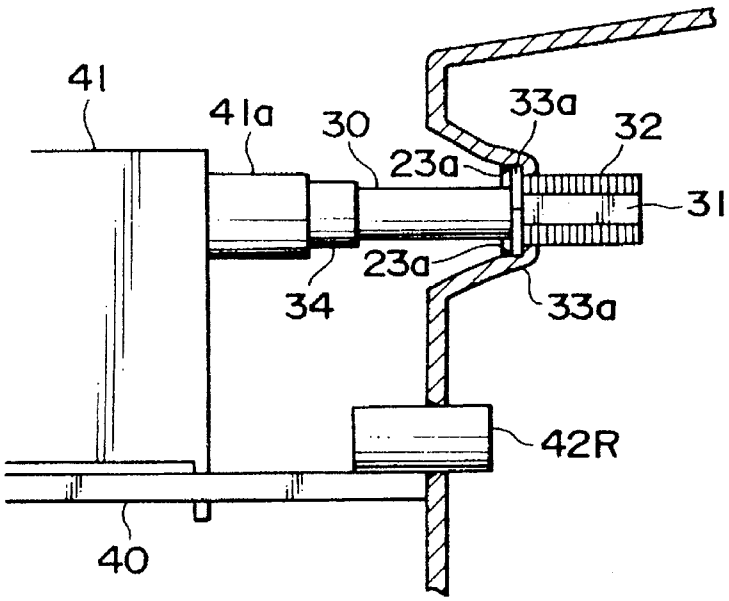
FIGS. 6A and 6B are side views of states in which an F connector 31 is put through the connector hole.
Figure 6A:
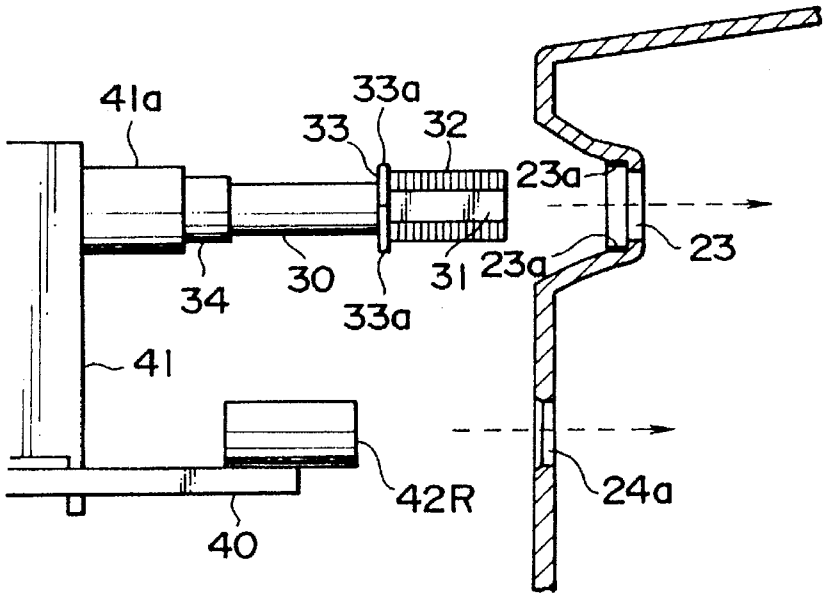
Figure 7:
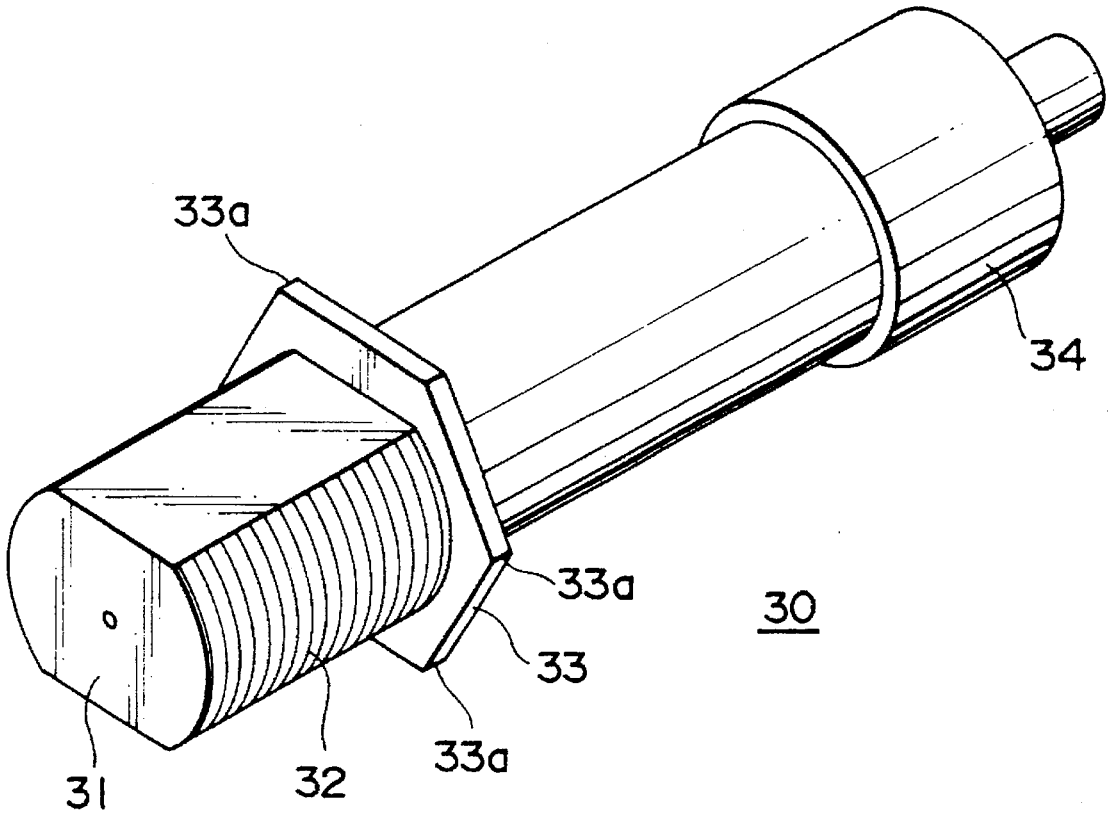
FIG. 7 (PRIOR ART)
FIG. 7 is a perspective view of a connector.
Figure 8:
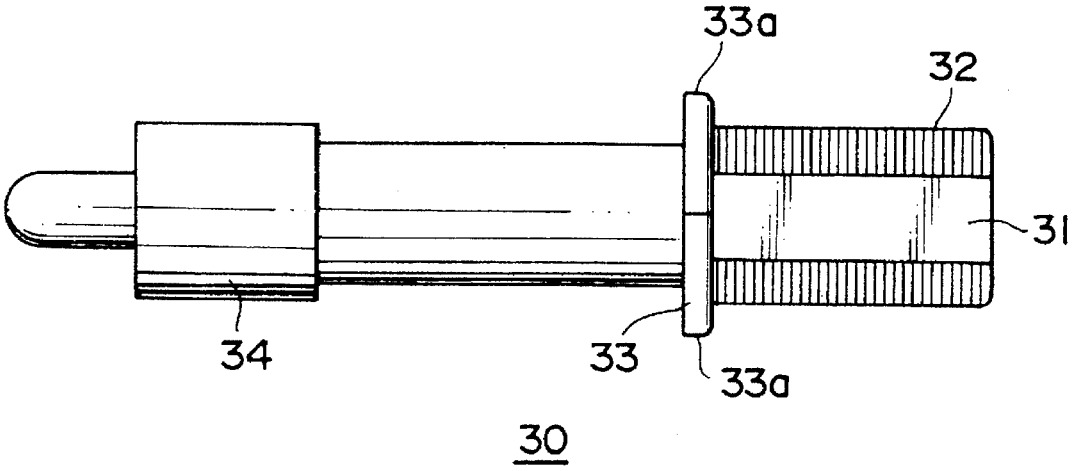
FIG. 8 (PRIOR ART)
FIG. 8 is a diagram showing a side view of the connector.
Figure 9:
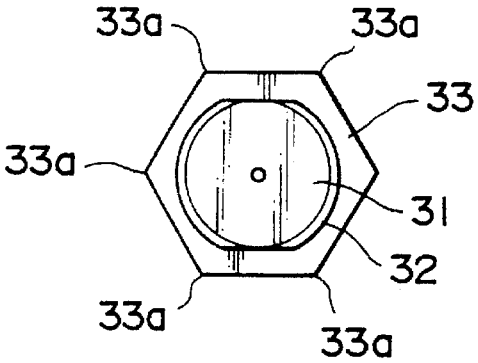
FIG. 9 (PRIOR ART)
FIG. 9 is a diagram showing a front view of the connector.

FIGS. 6A and 6B are side views in states where the F connector 31 is fixed to the connector hole 23. In each of the figures, the cross section of the connector hole 23 is shown. It should be noted, however, that the front enclosure 10 is not shown in either FIG. 6A or 6B. When the F connector 31 is about to be fixed to the connector hole 23, the connector 30 has already been connected to the board 40. As the board 40 is moved in a direction indicated by an arrow shown in FIG. 6A in this state, the F connector 31 is inserted into the connector hole 23 while the audio and video input terminals 42R, 42L and 42V pass through the through holes 24*a*, 24*b* and 24*c* respectively. At that time, the corners 33*a* of the flange 33 of the connector 30 get engaged with some of the dents 33*a* which are created to form a knurled shape on the inside circumference of the connector hole 23 as shown in FIG. 6*b* as described earlier.

In this embodiment, typically thirty six dents 23*a* are created on the inside circumference of the connector hole 23 as described above, allowing the six corners 33*a* of the flange 33 to be engaged with some of the dents 23*a*. In this way, the connector 30 can be fixed to the connector hole 23 so that the connector 30 is prevented from rotating. On top of that, the connector 30 can be fixed to the connector hole 23 without rotating the connector 30 when attaching the connector 30 to the terminal 41*a*.

In this embodiment, thirty six dents 23*a* are created to form a knurled shape on the inside circumference of the connector hole 23. It should be noted, however, that the shape of each of the dents 23*a* to be created, the dent count, etc. can be determined in accordance with the shape of each of the corners 33*a* to be engaged with the dents 23*a*. In addition, the embodiment implements the present invention in a television receiver as is described above. It should be kept in mind that the present invention can also be applied to any other equipment such a video deck, wherein a circuit board inside its cabinet is connected to an external antenna installed outside the cabinet by passing a connector through a predetermined connector hole.

What is claimed is:

1. An electronic component assembly having an installation unit for installing a connector, comprising:

an electronic circuit unit;

a circuit board for mounting said electronic circuit unit;

an output terminal provided on said electronic circuit unit;

a cylindrical connector having a flange with a plurality of corners for attachment to said output terminal;

an enclosure for enclosing said electronic circuit unit and said circuit board; and a connector hole provided at a predetermined location on said enclosure and including a plurality of preformed dents created on a portion of an inside circumference of said connector hole, wherein said plurality of corners of said flange are engaged with said plurality of preformed dents when said cylindrical connector extends through said connector hole, and said plurality of preformed dents is greater in number than said plurality of corners.

2. An electronic component assembly according to claim 1, wherein said cylindrical connector has an end with a diameter smaller than a diameter of said flange and said connector hole comprises a cylindrical hollow portion with a diameter slightly greater than that of said end and said dents are engaged with said corners of said flange on a circumference thereof having a diameter greater than that of said cylindrical hollow portion.

3. An electronic component assembly according to claim 2, wherein said flange has a polygonal shape.

4. An electronic component assembly according to claim 3, wherein said enclosure has a second connector hole for receiving therethrough a signal terminal provided on said circuit board.

5. An electronic component assembly according to claim 4, wherein said dents are arranged to form a knurled shape.

6. An electronic component assembly according to claim 4, wherein said dents are arranged at equal intervals around said portion of an inside circumference of said connector hole.

7. An electronic component assembly comprising: a circuit board inside a cabinet connected to equipment installed outside said cabinet by passing a connector having a polygonal flange through a connector hole, wherein said connector hole is created at a predetermined location on an enclosure forming said cabinet of said electronic component assembly; and a portion of an inside circumference of said connector hole is formed having a knurled shape for engagement with corners of said polygonal flange, said knurled shape comprising a number of dents greater than a number of corners of said polygonal flange.

8. An electronic component assembly according to claim 7, wherein said connector is an antenna connector used in a television receiver.

* * * * *